US010843714B2

(12) United States Patent
Akiyama et al.

(10) Patent No.: US 10,843,714 B2
(45) Date of Patent: Nov. 24, 2020

(54) CARBODY OF RAILCAR

(71) Applicant: KAWASAKI JUKOGYO KABUSHIKI KAISHA, Kobe (JP)

(72) Inventors: Satoru Akiyama, Kobe (JP); Jyoji Yamada, Kobe (JP); Shinichiro Hata, Kobe (JP); Yoshikazu Ohashi, Kobe (JP); Shinya Kimura, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 244 days.

(21) Appl. No.: 16/065,169

(22) PCT Filed: Dec. 19, 2016

(86) PCT No.: PCT/JP2016/087813
§ 371 (c)(1),
(2) Date: Jun. 22, 2018

(87) PCT Pub. No.: WO2017/110748
PCT Pub. Date: Jun. 29, 2017

(65) Prior Publication Data

US 2019/0001998 A1 Jan. 3, 2019

(30) Foreign Application Priority Data

Dec. 22, 2015 (JP) ..... 2015-249665

(51) Int. Cl.
*B61D 17/08* (2006.01)
*B61D 17/12* (2006.01)
(Continued)

(52) U.S. Cl.
CPC ..... *B61D 17/08* (2013.01); *B61D 17/12* (2013.01); *B61D 17/185* (2013.01); *B61D 49/00* (2013.01); *B61F 1/00* (2013.01)

(58) Field of Classification Search
CPC ..... B61D 17/00; B61D 17/02; B61D 17/06; B61D 17/08; B61D 17/12; B61D 17/18; B61D 17/185; B61D 49/00; B61F 1/00
See application file for complete search history.

(56) References Cited

U.S. PATENT DOCUMENTS 6,378,252 B1 * 4/2002 Bernard ..... B61C 17/04 296/186.1
2006/0101749 A1 * 5/2006 Aota ..... B61D 17/185 52/309.4
(Continued)

FOREIGN PATENT DOCUMENTS

JP H04-118356 A 4/1992
JP H06-156276 A 6/1994
(Continued)

*Primary Examiner* — Jason C Smith
(74) *Attorney, Agent, or Firm* — Oliff PLC

(57) ABSTRACT

A carbody of a railcar includes an underframe, a side bodyshell, and a roof bodyshell. At least one of the underframe, the side bodyshell, and the roof bodyshell includes: an outer plate portion facing a car outside; and a reinforced portion joined to an inside surface of the outer plate portion and forming at least one internal space between the reinforced portion and the outer plate portion. At least one sound absorbing hole communicating with the internal space is formed on the outer plate portion.

18 Claims, 7 Drawing Sheets

(51) Int. Cl.

| | |
|---|---|
| ***B61D 49/00*** | (2006.01) |
| ***B61F 1/00*** | (2006.01) |
| ***B61D 17/18*** | (2006.01) |

(56) References Cited

U.S. PATENT DOCUMENTS

2006/0175126 A1* 8/2006 Nakamoto ..... B61D 17/185 181/290
2008/0135327 A1* 6/2008 Matsumura ..... G10K 11/172 181/151
2010/0170745 A1* 7/2010 Pfeifer ..... G10K 11/162 181/284
2012/0234979 A1* 9/2012 Smith ..... B64C 1/40 244/158.1
2012/0305706 A1* 12/2012 Weston ..... B64C 1/40 244/119
2013/0042787 A1* 2/2013 Sugimoto ..... B61D 17/10 105/396
2013/0264147 A1* 10/2013 Sugimoto ..... B32B 3/266 181/292
2015/0114254 A1* 4/2015 Wadsworth ..... B61D 17/185 105/355
2019/0001998 A1* 1/2019 Akiyama ..... B61D 17/08
2019/0244597 A1* 8/2019 Chen ..... B60N 2/58
2019/0287543 A1* 9/2019 Sugai ..... H04S 7/30
2020/0017411 A1* 1/2020 Zhou ..... C04B 14/10

FOREIGN PATENT DOCUMENTS

JP 2003-081131 A 3/2003
JP 2004-042735 A 2/2004
JP 4286799 B2 7/2009
JP 2016222195 A * 12/2016 ..... B61D 17/06
WO 2006/106854 A1 10/2006

* cited by examiner

CARBODY OF RAILCAR

TECHNICAL FIELD

The present invention relates to a carbody of a railcar.

BACKGROUND ART

High speed railcars are subjected to various noise countermeasures, and therefore, a noise level is made lower than a predetermined environmental regulation value. For example, PTL 1 discloses a sound absorbing panel covering an underfloor device from a lower side and a lateral side, the underfloor device being provided under a carbody. According to this, noises reflecting between the car and a ground wall surface (such as a soundproof wall surface or a tunnel wall surface) located beside a permanent way can be absorbed by the sound absorbing panel.

CITATION LIST

Patent Literature

PTL 1: Japanese Patent No. 4286799

SUMMARY OF INVENTION

Technical Problem

In recent years, railcars are further increasing in speed. Since noise is substantially proportional to the square of a car travelling speed or more, further noise countermeasures are desired in some cases. For example, when the sound absorbing panel is provided not only around the underfloor device provided under the carbody but also a side surface of the carbody, a large sound absorbing area can be secured. However, when the sound absorbing panel is provided on a side surface of a side bodyshell of the carbody, the side bodyshell needs to be positioned at an inner side in a car width direction by the thickness of the sound absorbing panel from the viewpoint of car gauge, and this causes a problem that a passenger room space of the carbody narrows. Further, since work of joining the sound absorbing panel to an outer surface of the side bodyshell is necessary, car assembly man-hours increase, and the number of parts of the car also increases.

An object of the present invention is to satisfactorily absorb noise of a railcar without narrowing a passenger room space of a carbody while preventing the number of parts and car assembly man-hours from increasing.

Solution to Problem

A carbody of a railcar according to one aspect of the present invention a carbody including an underframe, a side bodyshell, and a roof bodyshell, at least one of the underframe, the side bodyshell, and the roof bodyshell including an outer plate portion and a reinforced portion, the outer plate portion facing a car outside, the reinforced portion being connected to an inside surface of the outer plate portion and forming at least one internal space between the reinforced portion and the outer plate portion, at least one sound absorbing hole being formed at the outer plate portion and communicating with the internal space.

According to the above configuration, since a sound absorbing function is given to the carbody itself, sound absorption can be performed by the carbody without providing a sound absorbing panel on an outer surface of the outer plate portion of the carbody. Therefore, the noise of the railcar can be satisfactorily absorbed without narrowing the passenger room space of the carbody while preventing the number of parts and the car assembly man-hours from increasing.

Advantageous Effects of Invention

According to the present invention, the noise of the railcar can be satisfactorily absorbed without narrowing the passenger room space of the carbody while preventing the number of parts and the car assembly man-hours from increasing.

DESCRIPTION OF EMBODIMENTS

Hereinafter, embodiments will be explained with reference to the drawings.

Embodiment 1

Figure 1:
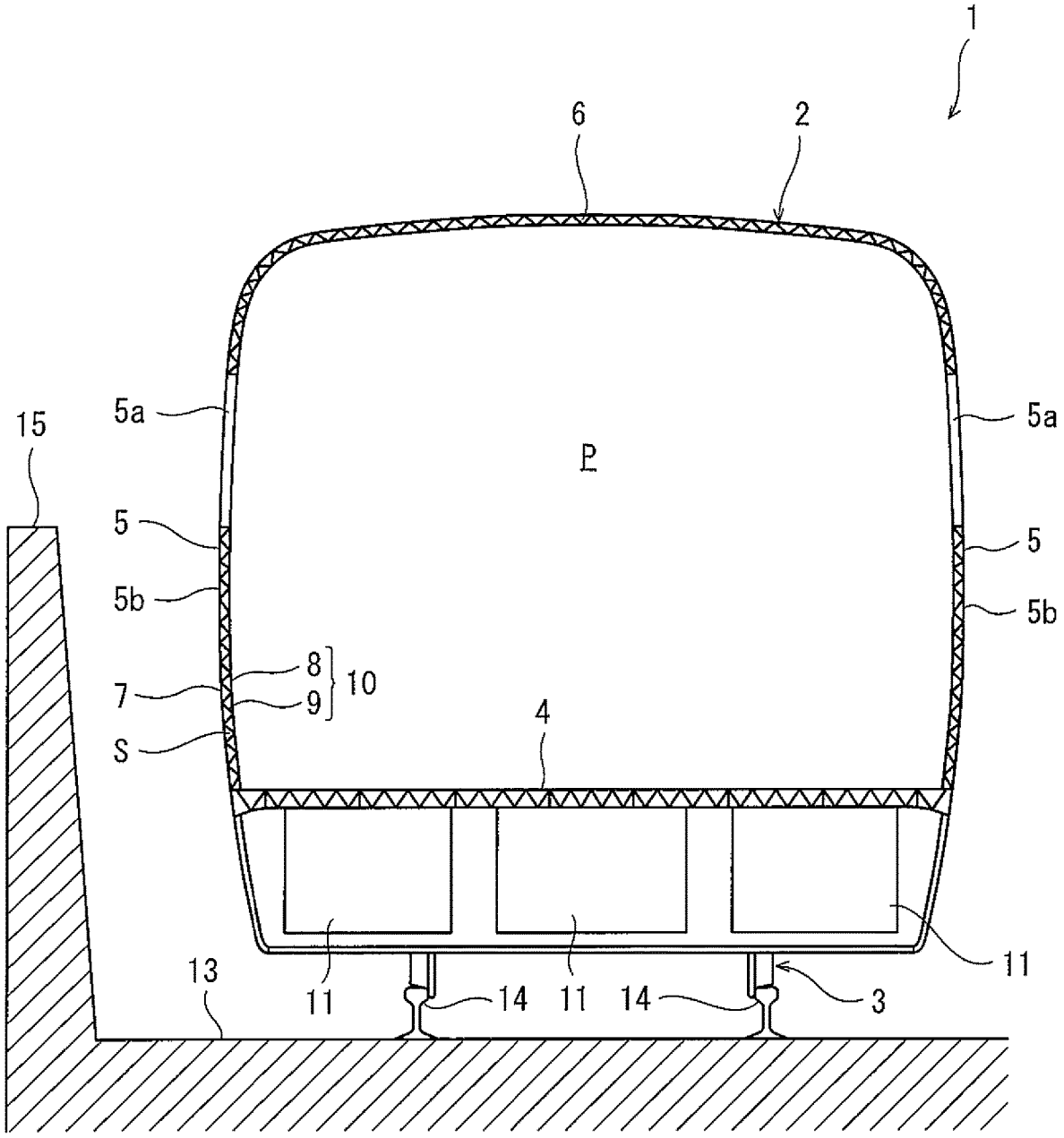
FIG. 1 is a sectional view when viewing a railcar according to Embodiment 1 from a car longitudinal direction.

FIG. 1 is a sectional view when viewing a railcar 1 according to Embodiment 1 from a car longitudinal direction. As shown in FIG. 1, the railcar 1 includes: a carbody 2 including therein a passenger room space P; and a bogie 3 supporting the carbody 2. The carbody 2 includes: an underframe 4; side bodyshells 5 including respective window openings 5*a* and extending upward from respective car width direction end portions of the underframe 4; and a roof bodyshell 6 connected to upper end portions of the side bodyshells 5. Each of the underframe 4, the side bodyshells 5, and the roof bodyshell 6 is a double skin bodyshell having a truss structure section and is formed by extrusion molding using light metal (for example, aluminum alloy).

The side bodyshell 5 includes: an outer plate portion 7 facing a car outside; and a reinforced portion 10 connected to an inside surface of the outer plate portion 7 and forming a plurality of internal spaces S between the reinforced portion 10 and the outer plate portion 7. Carbody longitudinal direction end portions of the internal spaces S are closed by lids, not shown (for example, end bodyshells). The reinforced portion 10 includes: an inner plate portion 8 arranged at a car inside of the outer plate portion 7 so as to be spaced apart from the outer plate portion 7; and a plurality of coupling rib portions 9 coupled to the outer plate portion 7 and the inner plate portion 8. The plurality of coupling rib portions 9 form a plurality of triangles in a truss shape together with the outer plate portion 7 and the inner plate portion 8. It should be noted that each of the underframe 4 and the roof bodyshell 6 has the same structure as the side bodyshell 5.

A plurality of underfloor devices 11 (for example, an inverter, a transformer, and the like) attached to the underframe 4 are arranged under the carbody 2. Rails 14 on which the bogie 3 travels are laid on a ground surface 13, and a soundproof wall 15 projects upward from the ground surface 13. The soundproof wall 15 is arranged beside the railcar 1 and projects to a position higher than the underframe 4 and lower than the window opening 5*a*.

Figure 2:
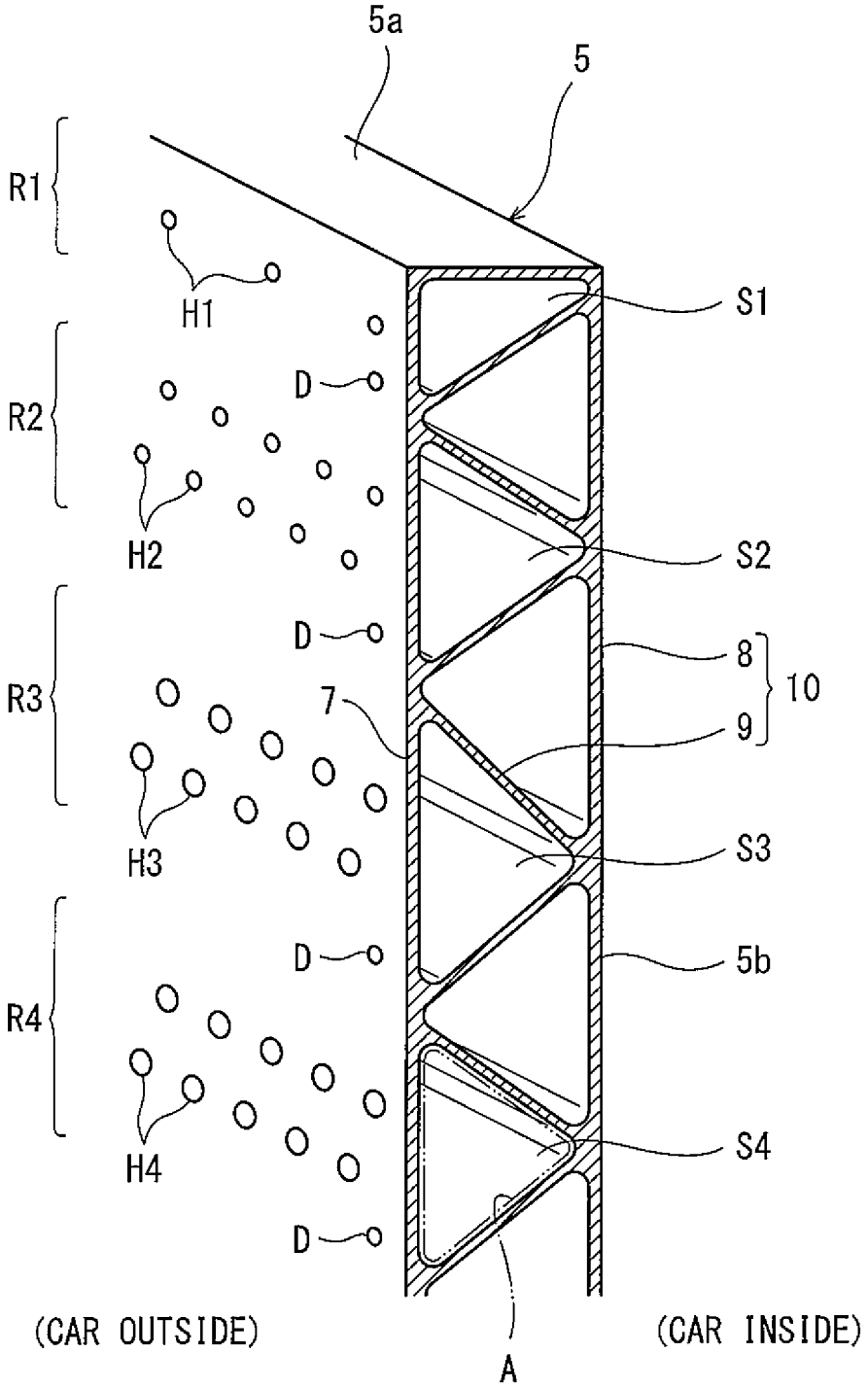
FIG. 2 is a sectional perspective view showing an upper part of a wainscot panel region of a side bodyshell shown in FIG. 1.
Figure 3:
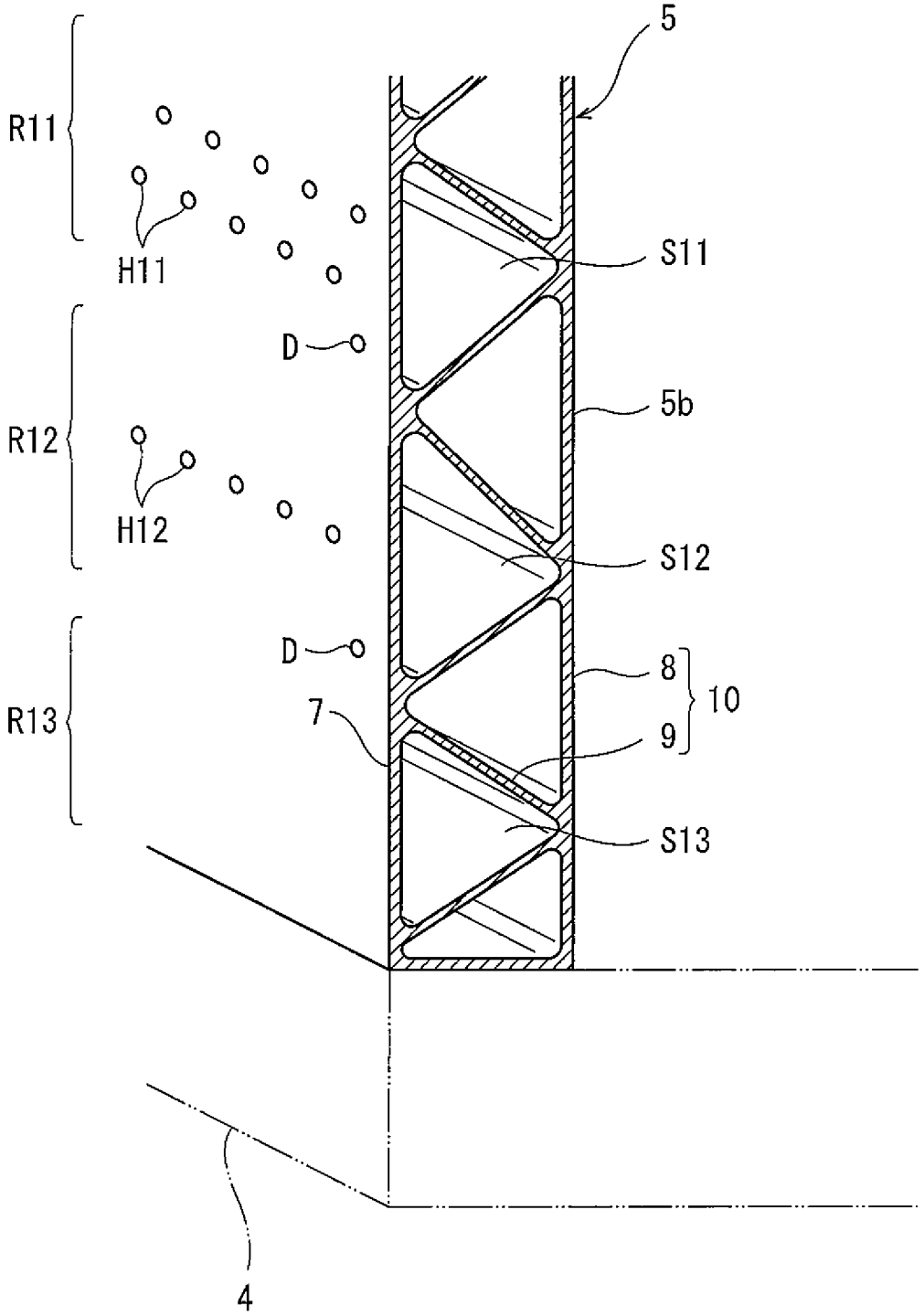
FIG. 3 is a sectional perspective view showing a lower part of the wainscot panel region of the side bodyshell shown in FIG. 1.

FIG. 2 is a sectional perspective view showing an upper part of a wainscot panel region 5*b* of the side bodyshell 5 shown in FIG. 1. FIG. 3 is a sectional perspective view showing a lower part of the wainscot panel region 5*b* of the side bodyshell 5 shown in FIG. 1. As shown in FIGS. 2 and 3, in the wainscot panel region 5*b* included in the side bodyshell 5 and located between the underframe 4 and the window opening 5*a*, the plurality of (in the present embodiment, 13) internal spaces S are provided so as to be lined up in a vertical direction, and each of the internal spaces S has a triangular section whose base is an inner surface of the outer plate portion. To be specific, a lower region 5*b* of the side bodyshell 5 is provided with a first internal space S1, a second internal space S2, a third internal space S3, a third internal space S4, . . . , an eleventh internal space S11, a twelfth internal space S12, and a thirteenth internal space S13 in this order from an upper side.

As shown in FIG. 2, a plurality of first sound absorbing holes H1 communicating with the first internal space S1 are formed in a first region R1 included in the outer plate portion 7 and facing the first internal space S1. A plurality of second sound absorbing holes H2 communicating with the second internal space S2 are formed in a second region R2 included in the outer plate portion 7 and facing the second internal space S2. A plurality of third sound absorbing holes H3 communicating with the third internal space S3 are formed in a third region R3 included in the outer plate portion 7 and facing the third internal space S3. A plurality of fourth sound absorbing holes H4 communicating with the fourth internal space S4 are formed in a fourth region R4 included in the outer plate portion 7 and facing the fourth internal space S4.

As shown in FIG. 3, a plurality of eleventh sound absorbing holes H11 communicating with the eleventh internal space S11 are formed in an eleventh region R11 included in the outer plate portion 7 and facing the eleventh internal space S11. A plurality of twelfth sound absorbing holes H12 communicating with the twelfth internal space S12 are formed in a twelfth region R12 included in the outer plate portion 7 and facing the twelfth internal space S12. Sound absorbing holes communicating with the thirteenth internal space S13 are not formed in a thirteenth region R13 included in the outer plate portion 7 and facing the lowest thirteenth internal space S13. The sound absorbing holes H1 to H12 are, for example, circular holes.

As shown in FIG. 2, a hole diameter and a hole length (a length of a hole in an axial direction) are the same between the first sound absorbing holes H1 and the second sound absorbing holes H2. However, an arrangement (i.e., a hole distribution shape) and an opening ratio are different between the first sound absorbing holes H1 and the second sound absorbing holes H2. Specifically, regarding the arrangement of the first sound absorbing holes H1, the first sound absorbing holes H1 are lined up in a row in a carbody longitudinal direction. Regarding the arrangement of the second sound absorbing holes H2, the second sound absorbing holes H2 are lined up in two rows in the carbody longitudinal direction, and carbody longitudinal direction positions of the second sound absorbing holes H2 in an upper row and carbody longitudinal direction positions of the second sound absorbing holes H2 in a lower row are displaced from each other. The opening ratio of the first sound absorbing holes H1 is lower than the opening ratio of the second sound absorbing holes H2.

The hole length, a hole pitch (i.e., an inter-hole distance), and the arrangement are the same between the second sound absorbing holes H2 and the third sound absorbing holes H3. However, the hole diameter is different between the second sound absorbing holes H2 and the third sound absorbing holes H3. Specifically, the hole diameter of the third sound absorbing hole H3 is larger than the hole diameter of the second sound absorbing hole H2. The hole diameter, the hole length, the opening ratio, and the arrangement are the same between the third sound absorbing holes H3 and the fourth sound absorbing holes H4. The opening ratio of the first region R1 of the outer plate portion 7 is lower than the opening ratio of the second region R2 of the outer plate portion 7, and the opening ratio of the second region R2 of the outer plate portion 7 is lower than the opening ratio of the third region R3 of the outer plate portion 7. In the present embodiment, regarding the regions R1 to R3 of the outer plate portion 7, generated stress is higher in the region closer to the window opening 5*a*, and strength decrease tolerance is lower in the region closer to the window opening 5*a*. Therefore, regarding the regions R1 to R3 of the outer plate portion 7, the opening ratio is set to be lower in the region closer to the window opening 5*a*. It should be noted that the opening ratio denotes a ratio of opening areas of all the sound absorbing holes in an area of the outer plate portion.

As shown in FIG. 3, the opening ratio of the lowest thirteenth region R13 of the outer plate portion 7 is zero. The hole diameter, the hole length, and the hole pitch are the same between the eleventh sound absorbing holes H11 and the twelfth sound absorbing holes H12. However, the arrangement (i.e., the hole distribution shape) is different between the eleventh sound absorbing holes H11 and the twelfth sound absorbing holes H12. Specifically, regarding the arrangement of the eleventh sound absorbing holes H11, the eleventh sound absorbing holes H11 are lined up in two rows in the carbody longitudinal direction, and the carbody longitudinal direction positions of the eleventh sound absorbing hole H11 in an upper row and the carbody longitudinal direction positions of the eleventh sound absorbing holes H11 in a lower row are displaced from each other. Regarding the arrangement of the twelfth sound absorbing holes H12, the twelfth sound absorbing holes H12 are lined up in a row in the carbody longitudinal direction. The opening ratio of the thirteenth region R13 of the outer plate portion 7 is lower than the opening ratio of the twelfth region R12 of the outer plate portion 7, and the opening ratio of the twelfth region R12 of the outer plate portion 7 is lower than the opening ratio of the eleventh region R11 of the outer plate portion 7. In the present embodiment, regarding the regions R11 to R13 of the outer plate portion 7, the generated stress is higher in the region closer to the underframe 4, and the strength decrease tolerance is lower in the region closer to the underframe 4. Therefore, regarding the regions R11 to R13 of the outer plate portion 7, the opening ratio is set to be lower in the region closer to the underframe 4.

Drain holes D are formed in the respective first to twelfth regions R1 to R12 of the outer plate portion 7 so as to communicate with respective lower end portions of the first to twelfth internal spaces S1 to S12. To be specific, the car longitudinal direction end portions of the first to twelfth internal spaces S1 to S12 are closed by lids (not shown), but even when water flows into the first to twelfth internal spaces S1 to S12 through the first to twelfth sound absorbing holes H1 to H12, the water is naturally discharged through the drain holes D. It should be noted that the drain holes D also serve as the sound absorbing holes.

A sound absorbing material A may be inserted into at least one of the first to thirteenth internal spaces S1 to S13. Various types of materials may be used as the sound absorbing material A, and for example, a porous material is used. The sound absorbing material A may be inserted into all the internal spaces with which the sound absorbing holes communicate, or may be selectively inserted into one or more internal spaces. One example is that the sound absorbing material A is not inserted into the internal space corresponding to the region in which the opening ratio is lower than a predetermined value, and the sound absorbing material A is inserted into the internal space corresponding to the region in which the opening ratio is the predetermined value or more.

According to the above explained configuration, a sound absorbing function is given to the side bodyshell 5 itself. Therefore, sound absorption can be performed by the carbody 2 without attaching a sound absorbing panel to an outer surface of the side bodyshell 5. On this account, the noise of the railcar 1 can be satisfactorily absorbed without narrowing the passenger room space P of the carbody 2 while preventing the number of parts and the car assembly man-hours from increasing. To be specific, even if a sound insulation property is reduced by forming the holes H1 to H12 on the side bodyshell 5, the noise outside the carbody 2 is reduced by the sound absorbing holes H1 to H12, so that the total amount of noise entering from the car outside into the car inside through the entire carbody 2 can be suppressed.

Since the sound absorbing holes H1 to H12 are arranged above the underframe 4 and under the window opening 5*a*, the noise reflecting between the soundproof wall 15 and the carbody 2 can be effectively absorbed. Further, since the sound absorbing holes H1 to H12 include sound absorbing holes among which at least one of the hole diameter, the hole length, the opening ratio, and the arrangement is different, suitable sound absorbing design can be realized in accordance with the characteristics of the noise.

Regarding the regions R11 to R13 of the outer plate portion 7, the opening ratio is set to be lower in the region closer to the underframe 4. Further, regarding the regions R1 to R3 of the outer plate portion 7, the opening ratio is set to be lower in the region closer to the window opening 5*a*. To be specific, the side bodyshell 5 includes both a portion whose required strength is high and a portion whose required strength is low. Based on this, by providing the sound absorbing holes H1 to H12 at appropriate positions of the outer plate portion 7, both maintaining the strength of the side bodyshell 5 and improving the sound absorbing performance can be realized.

Embodiment 2

Figure 4:
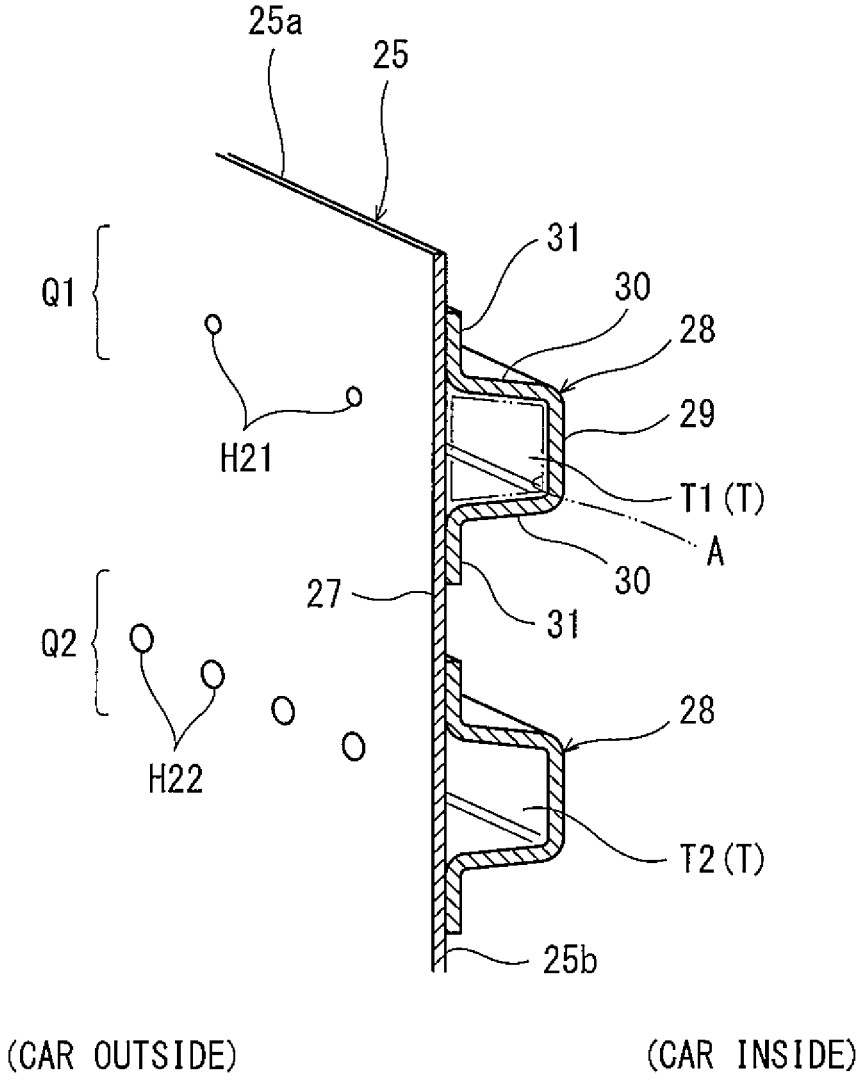
FIG. 4 is a sectional perspective view showing the upper part of the wainscot panel region of the side bodyshell of the railcar according to Embodiment 2.

FIG. 4 is a sectional perspective view showing an upper part of a wainscot panel region 25*b* of a side bodyshell 25 of the railcar according to Embodiment 2. As shown in FIG. 4, the wainscot panel region 25*b* included in the side bodyshell 25 and located between the underframe and a window opening 25*a* includes: an outer plate portion 27 facing a car outside; and reinforced portions 28 joined to the outer plate portion 27 by welding. The outer plate portion 27 and the reinforced portions 28 are formed by, for example, stainless steel plates. Each of the reinforced portions 28 is connected to an inside surface of the outer plate portion 27 and forms an internal space T between the reinforced portion 28 and the outer plate portion 27. The reinforced portion 28 includes a head portion 29, a pair of leg portions 30, and a pair of flange portions 31. The reinforced portion 28 is a horizontal frame member extending in the carbody longitudinal direction.

The head portion 29 is arranged at a car inside of the outer plate portion 27 so as to be spaced apart from the outer plate portion 27 and extends in the carbody longitudinal direction. The pair of leg portions 30 extend from both respective ends (i.e., upper and lower ends) of the head portion 29 toward the outer plate portion 27. The pair of flange portions 31 extend from respective end portions of the pair of leg portions 30 in respective directions (i.e., upper and lower directions) opposite to each other, the end portions being located close to the outer plate portion 27. The pair of flange portions 31 are joined to the outer plate portion 27 by laser welding or spot welding. To be specific, the internal space T is surrounded by the outer plate portion 27, the pair of leg portions 30, and the head portion 29. Carbody longitudinal direction end portions of the internal spaces T are closed by lids, not shown (for example, the end bodyshells).

In the wainscot panel region 25*b* of the side bodyshell 25, a plurality of internal spaces T each having a square section are provided so as to be lined up in the vertical direction. To be specific, in the wainscot panel region 25*b* of the side bodyshell 25, a first internal space T1, a second internal space T2, . . . are provided in this order from an upper side. A plurality of first sound absorbing holes H21 communicating with the first internal space T1 are formed in a first region Q1 included in the outer plate portion 27 and facing the first internal space T1. A plurality of second sound absorbing holes H22 communicating with the second internal space T2 are formed in a second region Q2 included in the outer plate portion 7 and facing the second internal space T2.

The first sound absorbing holes H21 are arranged in a row in the carbody longitudinal direction, and the second sound absorbing holes H22 are arranged in a row in the carbody longitudinal direction. However, the hole diameter and the hole pitch are different between the first sound absorbing holes H21 and the second sound absorbing holes H22. Specifically, the hole diameter of the first sound absorbing hole H21 is smaller than the hole diameter of the second sound absorbing hole H22, and the hole pitch of the first sound absorbing holes H21 is larger than the hole pitch of the second sound absorbing holes H22. Further, the sound absorbing material A may be inserted into at least one of the internal spaces T1 and T2. As with Embodiment 1, the sound absorbing material A may be inserted into all the internal spaces or may be selectively inserted into one or more internal spaces.

According to the above explained configuration, the noise of the railcar can be effectively absorbed without narrowing the passenger room space of the carbody while preventing the number of parts and the car assembly man-hours from increasing. Further, suitable sound absorbing design can be realized in accordance with the characteristics of the noise. Furthermore, both maintaining the strength of the side bodyshell 25 and improving the sound absorbing performance can be realized. It should be noted that since the other components are the same as those in Embodiment 1, explanations thereof are omitted. In Embodiment 2, the horizontal frame member is used as the reinforced portion forming the internal space with which the sound absorbing holes of the outer plate portion communicate. However, a vertical frame member may be used as the reinforced portion.

Examples and Comparative Example

Next, Example and Comparative Example will be explained.

Table 1 shows specifications of the side bodyshell of Example 1. The side bodyshell of Example 1 has the same double skin structure as Embodiment 1 but is different in specifications from the example shown in FIGS. 2 and 3. In Table 1, "Region" corresponds to the first to twelfth regions R1 to R12 of the side bodyshell 5, "Surface length" corresponds to a length of the region in a height direction along the outer surface of the region, "Space sectional area" corresponds to a sectional area of the internal space (S1 to S12) having a triangular section, "Thickness" corresponds to the thickness of the outer plate portion 7 of the side bodyshell 5 and is equal to the hole length, "Hole diameter" corresponds to the hole diameter of the sound absorbing hole formed on the outer plate portion 7, "Opening ratio" corresponds to a ratio of opening areas of all the sound absorbing holes in an area of the outer plate portion, and "Resonance frequency" is represented by Formula 1. In Formula 1, S denotes the space sectional area, L denotes the surface length, R denotes the opening ratio, t denotes the thickness, and φ denotes the hole diameter.

TABLE 1

| Region | Surface length (mm) | Space sectional area (mm2) | Thickness (mm) | Hole diameter (mm) | Opening ratio (%) | Resonance frequency (Hz) |
|---|---|---|---|---|---|---|
| 1 | 35 | 360 | 4.5 | 10 | 1.5 | 708 |
| 2 | 60 | 760 | 3 | 10 | 2.4 | 887 |
| 3 | 65 | 900 | 3 | 10 | 2.4 | 855 |
| 4 | 75 | 900 | 3 | 10 | 2.6 | 956 |
| 5 | 75 | 900 | 3 | 10 | 2.3 | 901 |
| 6 | 75 | 900 | 3 | 10 | 2.1 | 855 |
| 7 | 65 | 900 | 3 | 10 | 2 | 780 |
| 8 | 60 | 850 | 3 | 10 | 1.6 | 695 |
| 9 | 65 | 850 | 4.5 | 10 | 1.6 | 652 |
| 10 | 70 | 810 | 5.1 | 10 | 1.5 | 645 |
| 11 | 35 | 500 | 5.25 | 10 | 1.5 | 576 |
| 12 | 35 | 510 | 5.25 | 10 | 1.5 | 570 |

$$\text{Resonance Frequency} = \frac{\text{Sound Speed}}{2\pi}\sqrt{\frac{LR}{S(t+0.8\varphi/2)}} \qquad \text{Formula 1}$$

Figure 5:
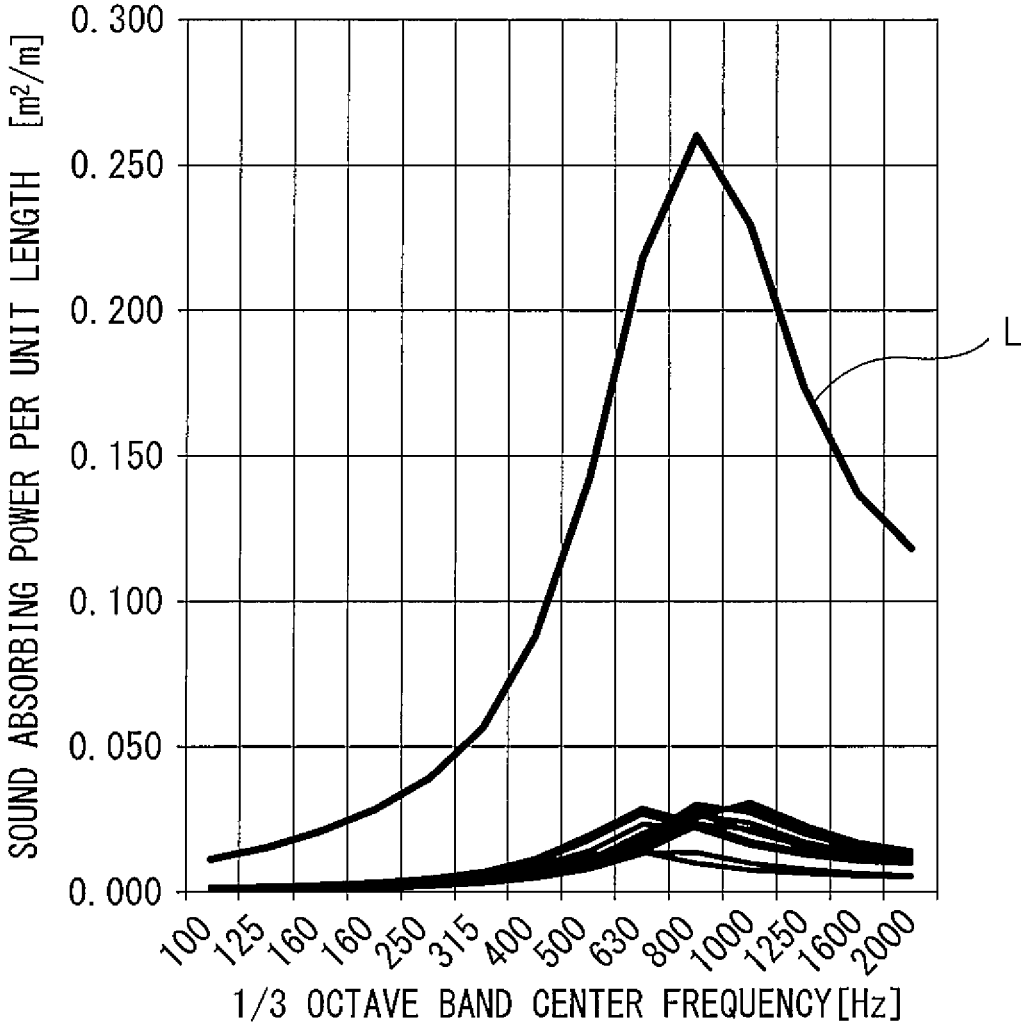
FIG. 5 is a graph showing sound absorbing power of the side bodyshell per unit length in Example 1.

FIG. 5 is a graph showing a relation between a sound absorbing power of the side bodyshell per unit length and a ⅓ octave band center frequency in Example 1. It should be noted that in each of the regions, the sound absorbing holes are arranged in a row in the car longitudinal direction. In the graph of FIG. 5, a line L shows values of the sound absorbing powers of the sound absorbing holes of all the first to thirteenth regions. In the graph of FIG. 5, each of lines other than the line L shows values of the sound absorbing power of the sound absorbing holes of each of the regions. As is clear from this graph, since values of the opening ratio of the sound absorbing holes, the space sectional area, and the like are different among the regions, the sound absorbing power is also different among the regions. Then, by combining the sound absorbing powers of the regions, the adequate total sound absorbing power is obtained, and a frequency band of the noise to be absorbed is widened.

Figure 6:
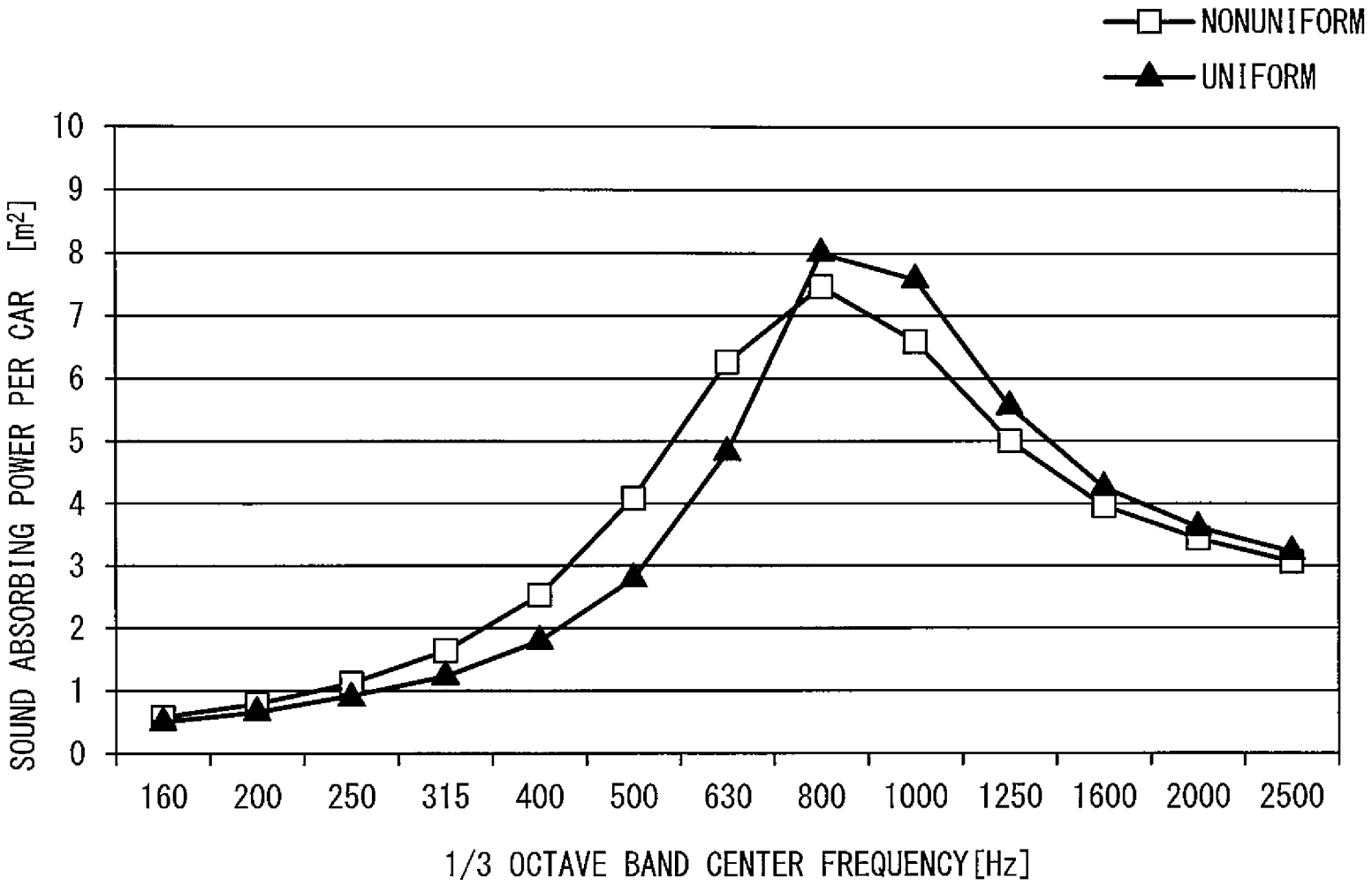
FIG. 6 is a graph showing the sound absorbing power per car in Examples 1 and 2.

FIG. 6 is a graph showing the sound absorbing power per car in Examples 1 and 2. In the graph of FIG. 6, a line (nonuniform) plotted by using squares corresponds to Example 1, and the hole diameter and the opening ratio are different among some of the regions. In the graph of FIG. 6, a line (uniform) plotted by using triangles corresponds to Example 2, and the frequency calculated by Formula 1 is set to be substantially the same among the regions. As is clear from this graph, when the hole diameter and the opening ratio are made different among the regions, the frequency band of the noise absorbed per car is widened. Further, when the hole diameter and the opening ratio are the same among the regions, a peak value of the sound absorbing power per car is increased.

Figure 7:
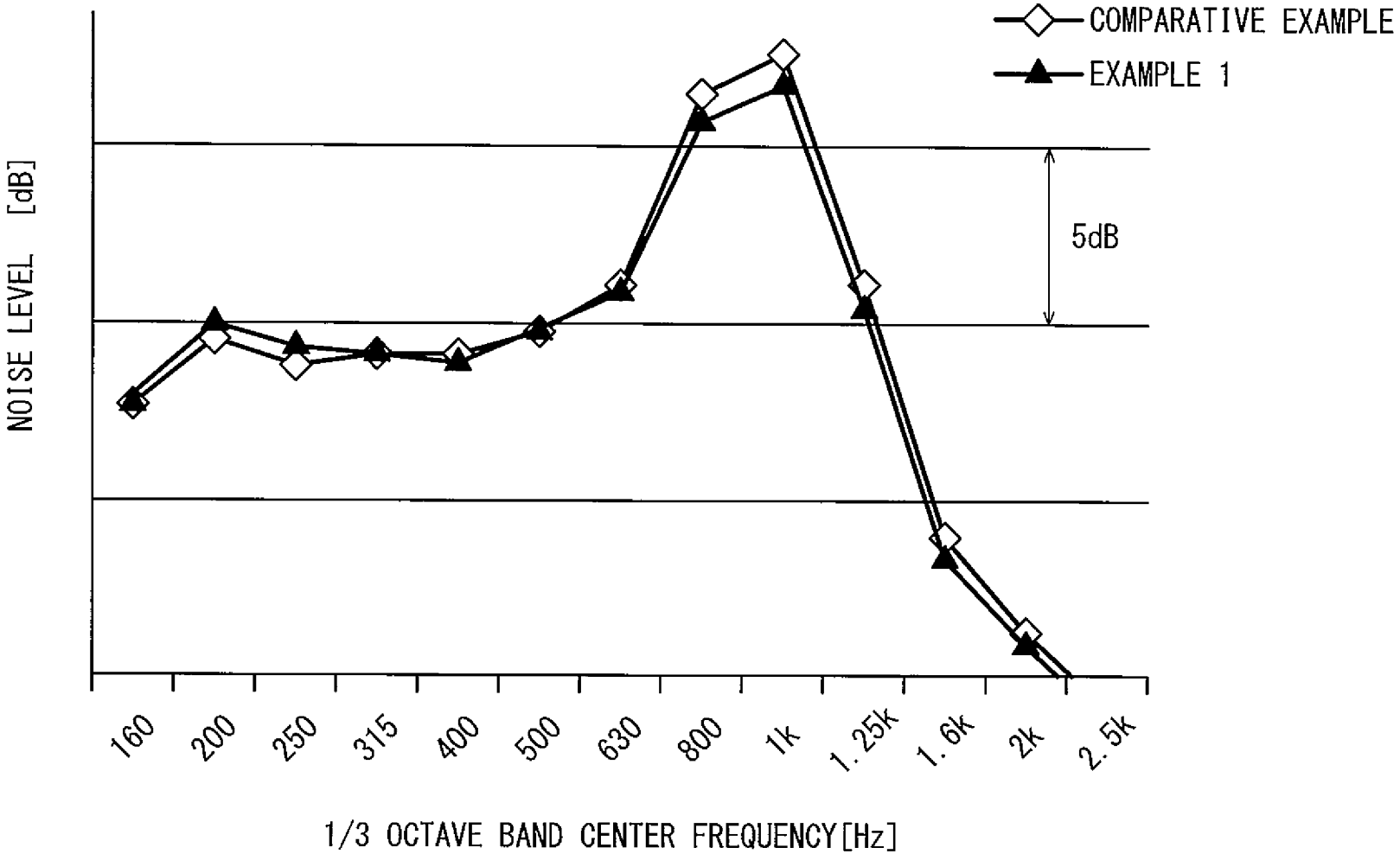
FIG. 7 is a graph showing a car inside noise level during tunnel traveling in Example 1 and Comparative Example.

FIG. 7 is a graph showing a car inside noise level during tunnel traveling in Example 1 and Comparative Example. In Comparative Example of FIG. 7, measurements are performed by using a car including a side bodyshell on which sound absorbing holes are not formed. As is clear from FIG. 7, in Example 1, even if the sound insulation property is reduced by the sound absorbing holes of the side bodyshell, the noise outside the car is reduced by the sound absorbing holes, so that the total amount of noise entering from the car outside to the car inside is made smaller than Comparative Example.

The present invention is not limited to the above embodiments, and modifications, additions, and eliminations may be made with respect to the configuration of the present invention. The above embodiments may be combined arbitrarily. For example, some of components or methods in one embodiment may be applied to another embodiment. Further, some of components in the embodiment may be separated and extracted arbitrarily from the other components in the embodiment. Although the sound absorbing holes are provided at the region included in the side bodyshell and located between the underframe and the window opening, the sound absorbing holes may also be provided at a region included in the side bodyshell and located above the window opening. The sound absorbing holes may be provided at the underframe and/or the roof bodyshell in addition to or instead of the side bodyshell. The internal spaces with which the sound absorbing holes of the side bodyshell communicate are not limited to the above embodiments. For example, the internal space may be an internal space of a side bodyshell having a double skin structure and have a square section. The shape of the sound absorbing hole is not especially limited and may be a long circular shape, an oval shape, a square shape, a polygonal shape, or the like instead of the circular shape.

REFERENCE SIGNS LIST

1 railcar
2 carbody
3 bogie
4 underframe
5, 25 side bodyshell
5*a* window opening
5*b* lower region
6 roof bodyshell
7, 27 outer plate portion
8 inner plate portion

9 coupling rib portion
10, 28 reinforced portion
25 side bodyshell
25*b* wainscot panel region
29 head portion
30 leg portion
31 flange portion
D drain hole
H1 to H12 first to twelfth sound absorbing holes
R1 to R13 first to thirteenth regions
Q1 to Q13 first to thirteenth regions
S, T internal space
S1 to S4, S11 to S13 first to fourth internal spaces, eleventh to thirteenth internal spaces
T1 and T2 first and second internal spaces

The invention claimed is:

1. A carbody of a railcar, the carbody comprising:
an underframe;
a side bodyshell; and
a roof bodyshell,
wherein:
at least one of the underframe, the side bodyshell, and the roof bodyshell is entirely formed of a double skin bodyshell having a truss structure section, the double skin bodyshell including:
an outer plate portion facing an outside of the railcar, and
a reinforced portion connected to an inside surface of the outer plate portion such that at least one internal space is formed between the reinforced portion and the outer plate portion,
the reinforced portion includes (i) an inner plate portion disposed at an inside of the railcar relative to the outer plate portion so as to be spaced apart from the outer plate portion, and (ii) a plurality of coupling rib portions coupled to the outer plate portion and the inner plate portion, the plurality of coupling rib portions forming a plurality of triangles in a truss shape together with the outer plate portion and the inner plate portion,
at least one sound absorbing hole is formed at the outer plate portion, the at least one sound absorbing hole communicating with the at least one internal space, and
upon the underframe being entirely formed of the double skin bodyshell, the underframe is configured to attach to underfloor devices at the outer plate portion.

2. The carbody according to claim 1, wherein the sound absorbing hole is formed on the side bodyshell and arranged above the underframe and under a window opening of the side bodyshell.

3. The carbody according to claim 1, wherein a plurality of sound absorbing holes is formed at the outer plate portion, the plurality of sound absorbing holes including the at least one sound absorbing hole.

4. The carbody according to claim 1, wherein:
the at least one internal space includes a first internal space and a second internal space;
the at least one sound absorbing hole includes at least one first sound absorbing hole communicating with the first internal space and at least one second sound absorbing hole communicating with the second internal space; and
at least one of a hole diameter, an opening ratio, a hole length, and an arrangement is different between the first sound absorbing hole and the second sound absorbing hole.

5. The carbody according to claim 4, wherein:
a generated stress of a first region included in the outer plate portion and facing the first internal space is greater than generated stress of a second region included in the outer plate portion and facing the second internal space; and
an opening ratio of the first region is less than an opening ratio of the second region.

6. The carbody according to claim 4, wherein:
the sound absorbing hole is formed on the side bodyshell;
the first internal space is arranged closer to the underframe than the second internal space; and
an opening ratio of a first region included in the outer plate portion and facing the first internal space is less than an opening ratio of a second region included in the outer plate portion and facing the second internal space.

7. The carbody according to claim 4, wherein:
the sound absorbing hole is formed on the side bodyshell;
the first internal space is formed closer to a window opening of the side bodyshell than the second internal space; and
an opening ratio of a first region included in the outer plate portion and facing the first internal space is less than an opening ratio of a second region included in the outer plate portion and facing the second internal space.

8. The carbody according to claim 1, wherein the at least one sound absorbing hole includes a drain hole communicating with a lower end of the internal space.

9. The carbody according to claim 1, wherein a sound absorbing material is disposed in the at least one internal space.

10. A carbody of a railcar, the carbody comprising:
an underframe;
a side bodyshell; and
a roof bodyshell,
wherein:
at least one of the underframe, the side bodyshell, and the roof bodyshell includes an outer plate portion facing a car outside, and a reinforced portion connected to an inside surface of the outer plate portion such that at least one internal space is formed between the reinforced portion and the outer plate portion;
the reinforced portion includes:
a head portion,
a pair of leg portions extending from respective ends of the head portion toward the outer plate portion, and
a pair of flange portions extending from the corresponding leg portions in respective directions opposite to each other and joined to the outer plate portion; and
at least one sound absorbing hole is formed at the outer plate portion, the at least one sound absorbing hole communicating with the at least one internal space.

11. The carbody according to claim 10, wherein the sound absorbing hole is formed on the side bodyshell and arranged above the underframe and under a window opening of the side bodyshell.

12. The carbody according to claim 10, wherein a plurality of sound absorbing holes is formed at the outer plate portion, the plurality of sound absorbing holes including the at least one sound absorbing hole.

13. The carbody according to claim 10, wherein:
the at least one internal space includes a first internal space and a second internal space;
the at least one sound absorbing hole includes at least one first sound absorbing hole communicating with the first internal space and at least one second sound absorbing hole communicating with the second internal space; and at least one of a hole diameter, an opening ratio, a hole length, and an arrangement is different between the first sound absorbing hole and the second sound absorbing hole.

14. The carbody according to claim 13, wherein:

a generated stress of a first region included in the outer plate portion and facing the first internal space is greater than a generated stress of a second region included in the outer plate portion and facing the second internal space; and an opening ratio of the first region is less than an opening ratio of the second region.

15. The carbody according to claim 13, wherein:

the sound absorbing hole is formed on the side bodyshell;

the first internal space is arranged closer to the underframe than the second internal space; and an opening ratio of a first region included in the outer plate portion and facing the first internal space is less than an opening ratio of a second region included in the outer plate portion and facing the second internal space.

16. The carbody according to claim 13, wherein:

the sound absorbing hole is formed on the side bodyshell;

the first internal space is formed closer to a window opening of the side bodyshell than the second internal space; and an opening ratio of a first region included in the outer plate portion and facing the first internal space is less than an opening ratio of a second region included in the outer plate portion and facing the second internal space.

17. The carbody according to claim 10, wherein the at least one sound absorbing hole includes a drain hole communicating with a lower end of the internal space.

18. The carbody according to claim 10, wherein a sound absorbing material is disposed in the at least one internal space.

* * * * *